US010385666B2

(12) United States Patent
Stanecki et al.

(10) Patent No.: US 10,385,666 B2
(45) Date of Patent: Aug. 20, 2019

(54) OIL RECOVERY WITH FISHBONE WELLS AND STEAM

(71) Applicant: CONOCOPHILLIPS COMPANY, Houston, TX (US)

(72) Inventors: John A. Stanecki, Katy, TX (US); Thomas J. Wheeler, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/595,614

(22) Filed: Jan. 13, 2015

(65) Prior Publication Data

US 2015/0198022 A1 Jul. 16, 2015

Related U.S. Application Data

(60) Provisional application No. 61/926,659, filed on Jan. 13, 2014.

(51) Int. Cl.
*E21B 43/24* (2006.01)
*E21B 43/30* (2006.01)

(52) U.S. Cl.
CPC ..... *E21B 43/24* (2013.01); *E21B 43/2406* (2013.01); *E21B 43/2408* (2013.01); *E21B 43/305* (2013.01)

(58) Field of Classification Search
CPC .. E21B 43/24; E21B 43/2406; E21B 43/2408; E21B 43/305
See application file for complete search history.

(56) References Cited

U.S. PATENT DOCUMENTS 3,385,360 A * 5/1968 Smith ..... E21B 43/20 166/272.3
4,060,129 A * 11/1977 Gomaa ..... E21B 43/24 166/252.1
4,874,043 A * 10/1989 Joseph ..... E21B 43/24 166/272.3
5,246,071 A * 9/1993 Chu ..... E21B 43/30 166/245
5,273,111 A * 12/1993 Brannan ..... E21B 43/2406 166/245
5,860,475 A * 1/1999 Ejiogu ..... E21B 43/2406 166/245

(Continued)

FOREIGN PATENT DOCUMENTS

CA 2684049 4/2011
EP 2193251 9/2016

OTHER PUBLICATIONS

Stalder J.L., et al., "Alternative Well Configurations in SAGD: Rearranging Wells to Improve Performance," presented at 2012 World Heavy Oil Congress [WHO12].

(Continued)

*Primary Examiner* — William D Hutton, Jr.
*Assistant Examiner* — Crystal J Miller
(74) *Attorney, Agent, or Firm* — Boulware & Valoir

(57) ABSTRACT

The present disclosure relates to a particularly effective well configuration that can be used for steam-drive based oil recovery methods. Fishbone multilateral wells are combined with steam drive, effectively allowing drive processes to be used where previously the reservoir lacked sufficient injectivity to allow steam drive or cyclic steam based methods.

6 Claims, 8 Drawing Sheets

(56) References Cited

U.S. PATENT DOCUMENTS 6,257,334 B1 * 7/2001 Cyr ..... E21B 43/2406 166/263
7,066,254 B2 * 6/2006 Vinegar ..... E21B 36/04 166/245
8,118,095 B2 * 2/2012 Sarathi ..... E21B 43/305 166/256
8,307,915 B2 * 11/2012 Clark ..... E21B 41/0035 166/245
8,333,245 B2 12/2012 Zupanick et al.
8,376,052 B2 2/2013 Zupanick et al.
8,381,810 B2 * 2/2013 Dreher, Jr. ..... E21B 43/243 166/245
8,695,730 B2 * 4/2014 Clark ..... E21B 41/0035 166/245
8,701,770 B2 * 4/2014 Schultz ..... E21B 36/02 166/272.7
9,388,676 B2 * 7/2016 Jorshari ..... E21B 43/2406
2003/0155111 A1 * 8/2003 Vinegar ..... E21B 36/04 166/59
2006/0175061 A1 * 8/2006 Crichlow ..... E21B 43/2406 166/302
2007/0044957 A1 * 3/2007 Watson ..... E21B 33/03 166/245
2009/0255661 A1 * 10/2009 Clark ..... E21B 41/0035 166/50
2010/0206555 A1 * 8/2010 Menard ..... E21B 43/2406 166/245
2010/0206563 A1 * 8/2010 Sarathi ..... E21B 43/305 166/256
2011/0036576 A1 * 2/2011 Schultz ..... E21B 36/02 166/303
2011/0067858 A1 * 3/2011 Dreher ..... E21B 43/243 166/251.1
2012/0227966 A1 9/2012 Dreher, Jr. et al.
2012/0241150 A1 * 9/2012 Al Yahyai ..... E21B 43/14 166/270
2012/0247760 A1 * 10/2012 Wheeler ..... E21B 43/2406 166/272.3
2013/0075084 A1 * 3/2013 Clark ..... E21B 41/0035 166/245
2013/0118737 A1 * 5/2013 Schneider ..... E21B 43/2406 166/272.3
2013/0146285 A1 * 6/2013 Chhina ..... E21B 43/00 166/268
2014/0048259 A1 * 2/2014 Menard ..... E21B 43/24 166/272.3
2014/0124194 A1 * 5/2014 Jorshari ..... E21B 43/2406 166/245
2014/0182850 A1 * 7/2014 Shahin ..... E21B 43/2406 166/266
2014/0345855 A1 * 11/2014 Wilfing ..... E21B 43/305 166/245
2014/0345861 A1 * 11/2014 Stalder ..... E21B 43/16 166/268
2014/0367097 A1 * 12/2014 Milam ..... E21B 43/24 166/272.4
2015/0083413 A1 * 3/2015 Salazar ..... E21B 43/2406 166/272.3
2015/0114637 A1 * 4/2015 Lo ..... E21B 43/2408 166/272.3
2015/0198027 A1 * 7/2015 Wickramathilaka ... C09K 8/592 166/272.4
2015/0240611 A1 * 8/2015 Joshari ..... E21B 43/2406 166/245

OTHER PUBLICATIONS

Lougheide, et al., "Trinidad's First Multilateral Well Successfully Integrates Horizontall Openhole Gravel Packs," OTC 16244, (2004).
Stalder, et al., "Multilateral-Horizontal Wells Increase Rate and Lower Cost Per Barrel in the Field, Faja, Venezuela", SPE 69700-MS, Mar. 12, 2001. Zuata.
Technical Advancements of Multilaterals (TAML) (2008).
Hogg, "Comparison of Multilateral Completion Scenarios and Their Application," presented at Offshore Europe, Aberdeen, United Kingdom, Sep. 9-12. SPE-38493-MS (1997).
Husain, et al., "Economic Comparison of Multi-Lateral Drilling over Horizontal Drilling for Marcellus Shale Field," EME 580 Final Report: (2011), available online at www.ems.psu.edu/~elsworth/courses/egee580/2011/Final%20Reports/fishbone_report.pdf.

* cited by examiner

FIG. 9
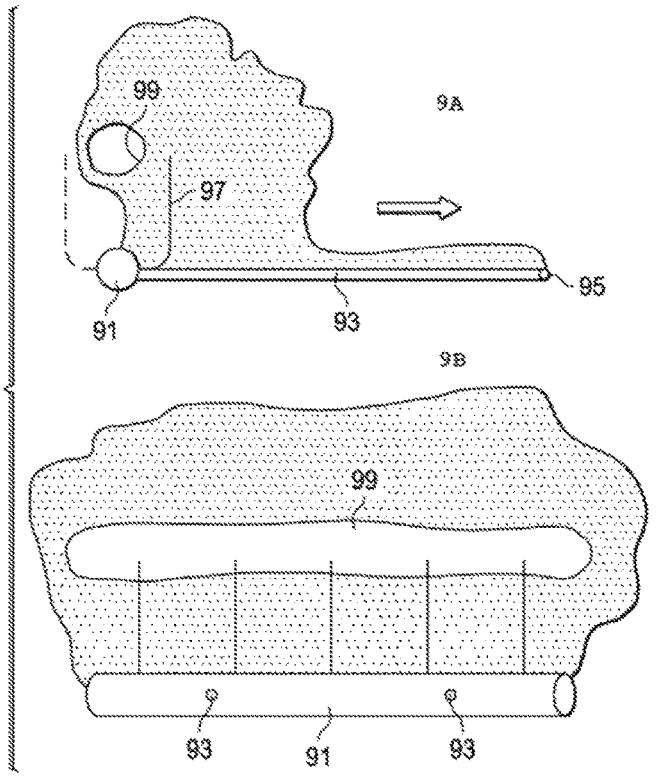
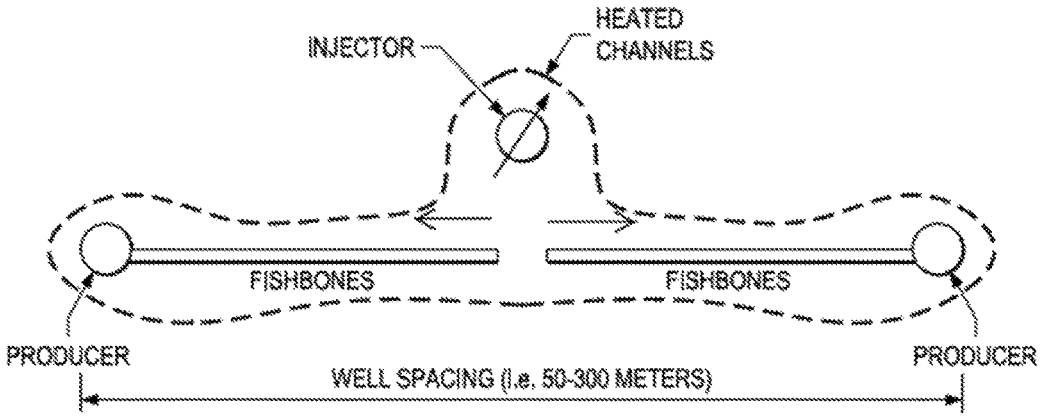
FIG. 10A

OIL RECOVERY WITH FISHBONE WELLS AND STEAM

PRIORITY CLAIM

This application is a non-provisional application which claims benefit under 35 USC § 119(e) to U.S. Provisional Application Ser. No. 61/926,659 filed Jan. 13, 2014, entitled "OIL RECOVERY WITH FISHBONE WELLS AND STEAM," which is incorporated herein in its entirety.

FEDERALLY SPONSORED RESEARCH STATEMENT

Not Applicable.

REFERENCE TO MICROFICHE APPENDIX

Not applicable.

FIELD OF THE DISCLOSURE

This disclosure relates generally to well configurations that can advantageously produce oil using steam-based mobilizing techniques, such as cyclic steam stimulation ("CSS") and steam drive ("SD"). In particular, fishbone wells are employed for CSS and SD, wherein a plurality of injectors and/or producers have multilateral wells that extend drainage and steam injection coverage throughout the entire region between the adjacent wells.

BACKGROUND OF THE DISCLOSURE

Oil sands are a type of unconventional petroleum deposit. The sands contain naturally occurring mixtures of sand, clay, water, and a dense and extremely viscous form of petroleum technically referred to as "bitumen," but which may also be called heavy oil or tar. Many countries in the world have large deposits of oil sands, including the United States, Russia, and the Middle East, but the world's largest deposits occur in Canada and Venezuela.

Bitumen is so heavy and viscous (thick) that it will not flow unless heated or diluted with lighter hydrocarbons. At room temperature, bitumen is much like cold molasses, and the viscosity can be in excess of 1,000,000 cP.

Due to their high viscosity, these heavy oils are hard to mobilize, and they generally must be made to flow in order to produce and transport them. One common way to heat bitumen is by injecting steam into the reservoir. Steam Assisted Gravity Drainage (SAGD) is the most extensively used technique for in situ recovery of bitumen resources in the McMurray Formation in the Alberta Oil Sands.

In a typical SAGD process, two horizontal wells are vertically spaced by 4 to 10 meters (m). The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within steam chamber.

This use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Although quite successful, SAGD does require enormous amounts of water in order to generate a barrel of oil. Some estimates provide that 1 barrel of oil from the Athabasca oil sands requires on average 2 to 3 barrels of water, although with recycling the total amount can be reduced to 0.5 barrel. In addition to using a precious resource, additional costs are added to convert those barrels of water to high quality steam for down-hole injection. Therefore, any technology that can reduce water or steam consumption has the potential to have significant positive environmental and cost impacts.

Additionally, SAGD is less useful in thin stacked pay-zones, because thin layers of impermeable rock in the reservoir can block the expansion of the steam chamber leaving only thin zones accessible and leaving much of the oil in other layers in place.

Indeed, in a paper by Shin & Polikar (2005), the authors simulated reservoir conditions to determine which reservoirs could be economically exploited. The simulation results showed that for Cold Lake-type reservoirs, a net pay thickness of at least 20 meters was required for an economic SAGD implementation. A net pay thickness of 15 m was still economic for the shallow Athabasca-type reservoirs because of the high permeability of this type of reservoir, despite the very high bitumen viscosity at reservoir conditions. In Peace River-type reservoirs, net pay thicker than 30 meters was expected to be required for a successful SAGD performance due to the low permeability of this type of reservoir. The results of the study indicate that the shallow Athabasca-type reservoir, which is thick with high permeability (high k×h), is a good candidate for SAGD application, whereas Cold Lake and Peace River-type reservoirs, which are thin with low permeability, are not as good candidates for conventional SAGD implementation.

Other steam based techniques include cyclic steam stimulation (CSS) and steam drive (SD), and these can be more suitable for thin or stacked pay-zones separated by impermeable layers since they often use vertical wells, providing fluid connection through heavily stratified reservoirs.

In a SD, sometimes known as a steam flood, some wells are used as steam injection wells and other wells are used for oil production. The wells can be either vertical or horizontal, but most steam floods are illustrated using vertical wells.

Two mechanisms are at work to improve the amount of oil recovered. The first is to heat the oil to higher temperatures and to thereby decrease its viscosity so that it more easily flows through the formation toward the producing wells. A second mechanism is the physical displacement that occurs in a manner similar to water flooding, in which oil is meant to be pushed to the production wells by the oncoming steam. While more steam is needed for this method than for the cyclic method, it is typically more effective at recovering a larger portion of the oil.

CSS, also known as the "Huff-and-Puff" method, consists of 3 stages: injection, soaking, and production. Steam is first injected into a well for a certain amount of time to heat the oil in the surrounding reservoir to a temperature at which it flows. After it is decided enough steam has been injected, the steam is usually left to "soak" for some time after (typically not more than a few days). Then oil is produced out of the same well, at first by natural flow (since the steam injection will have increased the reservoir pressure) and then by artificial lift. Production will decrease as the oil cools down, and once production reaches an economically determined level the steps are repeated again.

The process can be quite effective, especially in the first few cycles. However, it is typically only able to recover approximately 20% of the Original Oil in Place (OOIP), compared to steam assisted gravity drainage, which has been reported to recover over 50% of OOIP. It is quite common for wells to be produced in the cyclic steam manner for a few cycles before being put on a steam drive regime.

One concept for improving production is the "multilateral" or "fishbone" well configuration idea. The concept of fishbone wells for non-thermal horizontal wells was developed by Petrozuata in Venezuela starting in 1999. That operation was a cold, viscous oil development in the Faja del Orinoco Heavy Oil Belt. The basic concept was to drill open-hole side lateral wells or "ribs" off the main spine of a producing well prior to running slotted liner into the spine of the well. Such ribs appeared to significantly contribute to the productivity by increasing the area of reservoir contact of the wells when compared to wells without the ribs in similar geology. A variety of multilateral well configurations are possible, although many have not yet been tested.

The advantages of multilateral wells can include:

1) Higher Production. In the cases where thin pools are targeted, vertical wells yield small contact with the reservoir, which causes lower production. Drilling several laterals in thin reservoirs and increasing contact improves recovery. Slanted laterals can be of particular benefit in thin stacked pay zones.

2) Decreased Water/Gas Coning. By increasing the length of "wellbore" in a horizontal strata, the inflow flux around the wellbore can be reduced. This allows a higher withdrawal rate with less pressure gradient around the producer. Coning (literally a cone of water in the region of the producer) is aggravated by pressure gradients that exceed the gravity forces that stabilize fluid contacts (oil/water or gas/water), so that coning is minimized with the use of multilaterals because they minimize the pressure gradient.

3) Improved sweep efficiency. By using multilateral wells, the sweep efficiency may be improved, and/or the recovery may be increased due to the additional area covered by the laterals mitigating the natural heterogeneity in the reservoir.

4) Faster Recovery. Production from the multilateral wells is at a higher rate than that in single vertical or horizontal wells, because the reservoir contact is higher in multilateral wells.

5) Decreased environmental impact. The volume of consumed drilling fluids and the generated cuttings during drilling multilateral wells are less than the consumed drilling fluid and generated cuttings from separated wells, at least to the extent that two conventional horizontal wells are replaced by one dual lateral well and to the extent that laterals share the same mother-bore. The surface footprint is also smaller, as only one location is required. Therefore, the impact of the multilateral wells on the environment can be reduced.

6) Saving time and cost. Drilling several laterals in a single well may result in time and cost saving in comparison with drilling several separate wells in the reservoir.

Although an improvement, the multilateral well methods have disadvantages too. One disadvantage is that fishbone wells are more complex to drill and clean up. Indeed, some estimate that multilaterals cost about 20% more to drill and complete than conventional slotted liner wells. Another disadvantage is increased risk of accident or damage, due to the complexity of the operations and tools.

Sand control can also be difficult. In drilling multilateral wells, the mother well bore can be cased to control sand production, however, the legs branched from the mother well bore are usually open hole. Therefore, the sand control from the branches is not easy to perform. There is also increased difficulty in modeling and prediction due to the sophisticated architecture of multilateral wells.

Another area of uncertainty with the fishbone concept is whether the ribs will establish and maintain communication with the steam chambers, or will the open-hole ribs collapse and block flow. One of the characteristics of the Athabasca Oil Sands is that they are unconsolidated sands that are bound by the million-plus centipoises bitumen. When heated to 50-80° C. the bitumen becomes slightly mobile. At this point the open-hole rib could collapse. If so, flow would slow to a trickle, temperature would drop, and the rib would be plugged. However, if the conduit remains open at least long enough that the bitumen in the near vicinity is swept away with the warm steam condensate before the sand grains collapse, then it may be possible that a very high permeability, high water saturation channel might remain even with the collapse of the rib. In this case, the desired conduit would still remain effective.

Another uncertainty with many ribs along a fishbone producer of this type is that one rib may tend to develop preferentially at the expense of all the other ribs leading to very poor conformance and poor overall results. This would imply that some form of inflow control may be warranted to encourage more uniform development of all the ribs.

Multilateral wells have been used for a variety of patented methods. EP2193251 discloses a method of drilling multiple short laterals that are of smaller diameter. These multiple short laterals can be drilled at the same depth from the same main wellbore, so as to perform treatments in and from the small laterals to adapt or correct the performance of the main well, the formation properties, the formation fluids and the change of porosity and permeability of the formation. However, this method does not increase overall reservoir contact, nor improve injectivity, nor increase well-to-well fluid communication.

US20110036576 discloses a method of injecting a treatment fluid through a lateral injection well such that the hydrocarbon can be treated by the treatment fluid before production. However, the addition of treatment fluid is known in the field and this well configuration does not increase the contact with the hydrocarbon reservoir.

CA2684049 describes the use of infill wells (between pairs of SAGD well-pairs) that are equipped with multilateral wells, so as to allow the targeting of additional regions. However, no general applicability to SAGD was described in this application.

Pham and Stalder further developed the fishbone well idea to allow increased application for SAGD processes. U.S. Ser. Nos. 61/825,945, filed May 21, 2013, and 61/826,329, filed May 22, for example, describe general application of fishbone wells in SAGD, as well as developing a radial fishbone SAGD well configuration. Both disclosures allow increased contact with the reservoir, increased injectivity and further, the unique patterns reduced overall well numbers and well-pad costs. However, the well configurations shown therein are optimized for use with horizontal wells and gravity drainage, and not for the steam drive mechanisms of CSS and SD.

Therefore, although beneficial, the multilateral well concept could be further developed to address some of these disadvantages or uncertainties. In particular, a method that combines multilateral well architecture with steam drive processes and/or huff-and-puff processes would be beneficial, especially if such methods conserved the water, energy, and/or cost to produce a barrel of oil.

SUMMARY OF THE DISCLOSURE

CSS and SD processes have been widely used in heavy oil recovery for over 50 years. However, bitumen/heavy oil in the Canadian Oil sands totaling over 1.75 billion bbls in place is immobile at the reservoir conditions, making steam injection and mobilization of the bitumen through a drive process impractical below fracture gradient.

This disclosure overcomes the lack of initial injectivity into the immobile bitumen reservoir by utilizing open hole laterals, also known as "fishbones" or "ribs", thus allowing the more economical CSS and SD processes to be used in reservoirs previously thought to be unsuitable for such processes.

The fishbones connect adjacent horizontal wells placed near the base of the pay, creating conduits for steam injection and allowing drive processes to dominate oil production. Placing injector wells near the base of the pay is different from traditional SAGD, where injector producer wells are vertically higher by 4-10 meters from producers, which are located near the base of the pay.

In one embodiment of the process, upper injector wells drilled for conventional SAGD operations are eliminated, and instead all wells can be located near the based of the pay-zone, and used for injection, production or both. This isn't essential however, and upper injection wells could be still used if desired, particularly where SAGD processes might be employed some years after steam drive processes have reached their useful limits of production.

The steam is injected in one horizontal well-injector, flows through the fishbones, gives up latent heat and rapidly heats up the adjacent volume, mobilizing the bitumen in the process. Condensed steam and mobilized bitumen are produced in adjacent horizontal producers.

To accelerate the heat-up period in the reservoir, the producers can also be stimulated with steam and/or the flow in fishbones reversed for some period of time. Solvents, such as xylene or diesel, may also be used to initiate mobility in the fishbones, accelerating fishbone start-up. This can occur once, twice or more, depending on permeability and thickness.

With time gravity takes hold, and steam gradually rises above the fishbones and spreads laterally heating up the reservoir. Since there is a viscous pressure gradient between the injectors and producers, fluids can be produced more rapidly than in the conventional SAGD process, which is dominated by gravity forces. This process will allow access to thinner pay-zones and to pay-zones with poor injectivity, where recovery using steam drive was not previously possible.

Additional embodiments of this process include drilling a ghost hole (open-hole wellbore) above the producer, and connecting the two wellbores via vertically directed or slanted fishbones into or near the ghost hole. This can accelerate vertical steam chest development and the gravity override desired in the steam-drive sweep process.

Additional embodiments include filling the fishbones and/or ghost holes with high permeability materials, such as proppants, gravel, metallic materials, radio frequency absorbing material, or sand, which would help maintain a high permeability conduit advantageous during the initiation of the steam-drive process, yet avoid the open-hole collapse problems. This could also be achieved by running slotted liners or other completion systems that maintain hole integrity and the high permeability conduit required during the process initiation, but high permeability materials cost less to complete than slotted liners.

CSS-SD could be applicable in an offset injector producer arrangement shown in FIG. 10, which would allow for more efficient development of resources by reducing wellbores and surface facilities. Eventually, the steam chamber may enlarge to the point where gravity drive becomes significant (as shown). The initial oil recovery process could be CSS or SD or CSS followed by SD (as is typical) and the initial processes can also flip injector/producer wells. Thus, the overall SOR would be reduced as compared with a solely SAGD process, where a significant steam preheat of up to 6 months is needed to establish heat and steam communication between wells.

In an additional embodiment, this configuration of horizontal wells with fishbones could be applied to steam-solvent, steam-additive such as methane, propane or $CO_2$, or solvent only thermal non-thermal processes.

This process is also applicable to hydrocarbon reservoirs where CSS operations are the dominant recovery process. Additional embodiments of the process could include hybrid combinations of CSS, CSS-SD, SAGD-SD, where existing well infrastructure is utilized in the process.

With the use of multilateral wells, the horizontal wells can be spaced between 50 and 150 meters laterally from one another in parallel sets or radially arranged to extend drainage across reservoir areas developed from a single surface drilling pad. Typical SAGD wells are much closer than this. Additionally, the wells can all be low in the pay, although vertically offset injectors are not excluded.

The disclosure relates to well configurations that are used to improve steam recovery of oil, especially heavy oils. In general, fishbone wells replace conventional wellbores in CSS and SD operations. Either or both injector and producer wells are multilateral, and preferably the arrangement of lateral wells, herein called "ribs" is such as to provide overlapping coverage of the pay zone between the injector and producer wells.

The injector wells can be vertical or horizontal, or combinations thereof, as is appropriate for particular reservoirs. However, horizontal wells are most useful for oil sands, such as found in Alberta. Furthermore, the use of horizontal wells allows eventual conversion to a gravity driven mechanism, as SD reaches its useful production limit.

Where both well types have laterals, a pair of ribs can cover or nearly cover the distance between two wells, but where only one of the well types is outfitted with laterals, the lateral length can be doubled such that the single rib covers most of the distance between adjacent wells. It is also possible for laterals to intersect with each other or with one or both of the main wellbores. The ribs may be horizontal, slanted, or curved in the vertical dimension to optimize performance. Where pay is thin, horizontal laterals may suffice, but if the pay is thick and/or there are many stacked thin pay zones, it may be beneficial to combine horizontal and slanted laterals, thus contacting more of the pay zone. Vertically slanted laterals can also assist with vertical steam chamber development, which may be desirable in some instances.

Flow distribution control may be used in either or both the injectors and producers to further optimize performance along all the ribs instead of the ones closer to the heel, and to potentially lower the development cost. Because it is known in the art, the flow distribution control will not be discussed in detail herein.

With the fishbone CSS/SD methodology described herein, the injection wells need not be placed vertically above the producing well, but can be low in the pay, facilitating their additional use as production wells. In particular, a preferred embodiment may be to place the injectors and producers laterally apart by 50 to 150 meters, using the lateral wells to bridge the steam gaps. Combinations of laterals and vertical spacing may also be used.

The injectors and producers can be flipped, particularly early in the process where the laterals are being heating for steam drive processes.

The herein described well configurations have the potential to allow steam drive processes to be used in reservoirs that were previously thought to be unsuitable due to low permeability and/or injectivity. Since steam drive processes use less steam than SAGD, the inventive method has the potential to significantly affect the cost of oil production, as well as decrease the overall steam to oil ratio.

The invention can comprise any one or more of the following embodiments, in any combination:

A method of producing heavy oils from a reservoir by steam drive, comprising: providing a production well and an injection well spaced laterally apart from the production well; said production well having a plurality of lateral wells extending towards the injection well, or said injection well having a plurality of lateral wells extending towards the production well, or both; cycling between injecting steam and producing at each of at least one of said injection well and said production well to establish steam injectivity between the production well and the injection well along a path of the lateral wells; and injecting steam into said injection wells to steam drive heated heavy oil towards said productions wells while producing the oil at the production wells.

A method of producing heavy oils from a reservoir by steam drive, comprising: providing a plurality of horizontal production wells at a first depth at or near the bottom of a hydrocarbon play; providing a plurality of horizontal injection wells, each injection well laterally spaced at a distance D from an adjacent production well; providing a plurality of lateral wells originating from said plurality of horizontal production wells or said plurality of horizontal injection wells or both, wherein said plurality of lateral wells cover at least 95% of said distance D; cycling between injecting steam and producing through the laterals before injecting steam into said injection wells and steam driving heated heavy oils towards said production wells for production; wherein said reservoir lacks sufficient injectivity for steam drive without the use of said plurality of lateral wells.

A method of producing heavy oils from a reservoir by steam drive, comprising: injecting steam into a horizontal first well spaced laterally apart from a horizontal second well while producing fluids from the second well, wherein lateral wells extend between the first and second wells; and injecting steam into the second well while producing fluids from the first well.

An improved method of steam drive production of heavy oil from a reservoir lacking sufficient injectivity for steam drive, wherein a steam drive step comprises injecting steam into a first well and driving heated heavy oil towards a second well for production, the improvement comprising providing a plurality of open hole laterals between said first and second wells to improve injectivity sufficiently for steam drive, and cycling steam injections with production between said first and second well before commencing said steam drive step.

The method having a lower cumulative steam to oil ratio than the same reservoir and wells developed using a steam assisted gravity drainage process only.

The method including alternating steam injection into said injection well and said production wells to improve steam injectivity before commencing steam drive step.

The method wherein an open hole horizontal ghost hole is provided above at least one injection well, and one or more lateral wells slants towards said open hole horizontal ghost hole, and wherein step d) is followed by a steam assisted gravity drainage process once a steam chamber encompasses said open hole horizontal ghost hole.

The method of claim 3, wherein said distanced D is 50-300 meters, at least 50 meters, at least 100 meters or at least 150 meters.

By "providing" a well, we mean to drill a well or use an existing well. The term does not necessarily imply contemporaneous drilling because an existing well can be retrofitted for use, or used as is.

"Vertical" drilling is the traditional type of drilling in oil and gas drilling industry, and includes well <45° of vertical.

"Horizontal" drilling is the same as vertical drilling until the "kickoff point" which is located just above the target oil or gas reservoir (pay-zone), from that point deviating the drilling direction from the vertical to horizontal. By "horizontal" what is included is an angle within 45° (≤45°) of horizontal.

"Multilateral" wells are wells having multiple branches (laterals) tied back to a mother wellbore (also called the "originating" well), which conveys fluids to or from the surface. The branch or lateral may be vertical or horizontal, or anything therebetween.

A "lateral" well as used herein refers to a well that branches off an originating well. An originating well may have several such lateral wells (together referred to as multilateral wells), and the lateral wells themselves may also have lateral wells.

An "alternate pattern" or "alternating pattern" as used herein means that subsequent lateral wells alternate in direction from the originating well, first projecting to one side, then to the other.

As used herein a "slanted" well with respect to lateral wells, means that the well is not in the same plane as the originating well or the take off point of that lateral, but travels upwards or downwards from same.

Such lateral wells may also "intersect" if direct fluid communication is achieved by direct intersection of two lateral wells, but intersection is not necessarily implied in the terms "overlapping" wells. Where intersecting wells are specifically intended, the specification and claims will so specify.

By "nearly reach" we mean at least 95% of the distance between adjacent main wellbores is covered by a lateral or a pair of laterals.

By "main wellbores" what is meant are injector and producer wells. Producer wells can also be used for injection early in the process, and producers/injectors can be reversed.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| SAGD | Steam assisted gravity Drainage |
| CSS | Cyclic steam stimulation |
| SD | Steam drive |
| ES-SAGD | Expanding solvent-SAGD |
| bbl | Oil barrel, bbls is plural |
| SOR | Steam to oil ratio |
| OOIP | Original Oil in Place |

BRIEF DESCRIPTION OF THE DRAWINGS

FIG. 9 shows the use of a vertically displaced ghost hole and vertically slanting laterals to aid in vertical growth of the steam chamber (stippled). The right picture shows a side view, and the left is a side view rotated 90'.

FIG. 10A-C shows a side view of a combined CSS-SD and SAGD steam chamber (inside dotted line) over time. The initial processes can be a CSS (FIG. 10A) from one or more injectors, and injectors/producers can also be flipped. Once good steam and heat communication is achieved, the wells can be switched to SD processes (FIG. 10B), driving the oil to adjacent producers. Eventually, a vertical steam chamber will be created and gravity drainage will begin to contribute, until the process is more gravity driven than steam drive driven (FIG. 10C).

DESCRIPTION OF EMBODIMENTS

The present disclosure provides a novel well configuration for CSS or SD oil production, which we refer herein as a "fishbone" configuration, wherein injectors or producers or both are both fitted with a plurality of multilateral wells to assist in steam injectivity and allow CSS or SD or combinations thereof, in a region that would otherwise lack sufficient injectivity for such processes.

Figure 1A:
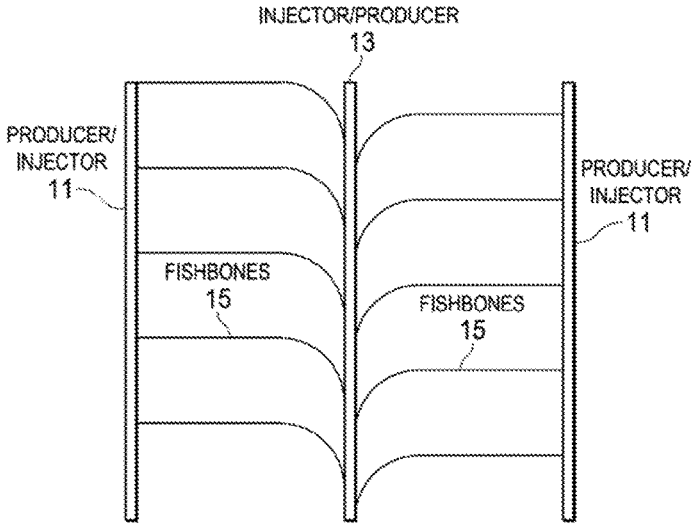
FIG. 1A shows a top view of an exemplary SD layout using fishbone laterals and horizontal wells.

Open-hole laterals—aka fishbones or ribs—connect (or nearly connect) adjacent horizontal well producers/injectors/ghost holes. Wells placed near the base of pay (see FIG. 1 for exemplary layouts), though in some cases (solvent only systems, for example), one or more well locations may be moved upward in the reservoir to optimize recovery. In some embodiments, a distance of less than 100 meters, less than 50 or about 35 meters separates the fishbones 15 from one another such that a laterally merged steam chamber above the fishbones 15 forms due to steam communication with adjacent ones of the fishbones 15 and progresses by steam drive down the length of the fishbones 15.

Figure 1B:
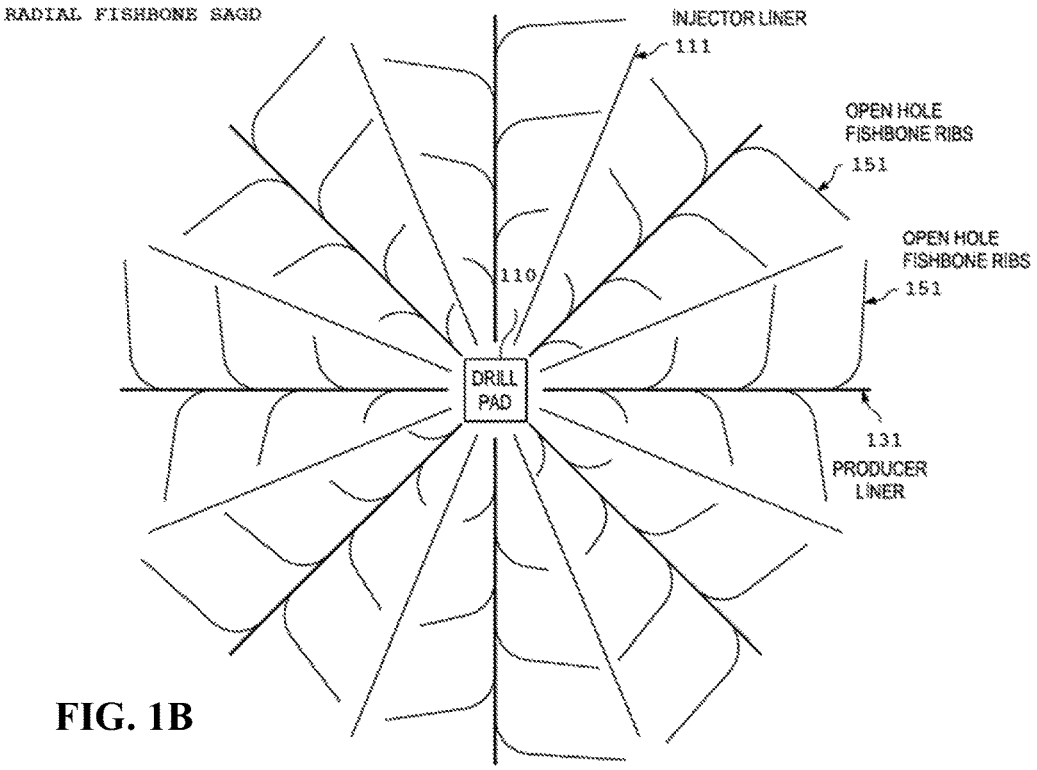
FIG. 1B shows a top view of an exemplary radial arrangement.
Figure 1C:
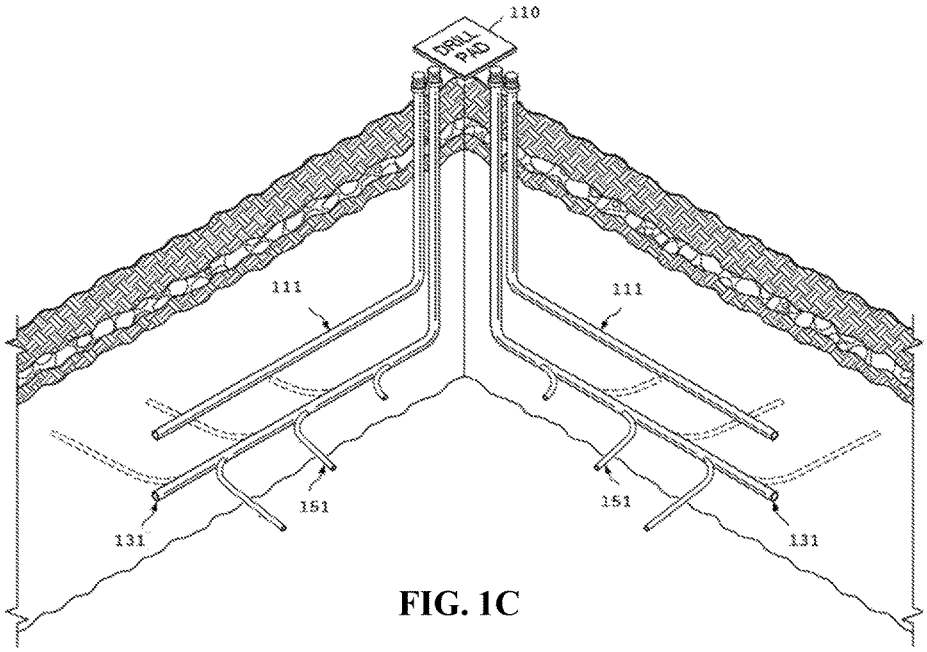
FIG. 1C shows the same radial arrangement as a cut away view.

The well layout could also be in a radial fashion (FIGS. 1B and 1C). In FIGS. 1B and 1C, injector 11 and producer 131 wells originate from a central wellpad 110. In this instance, the producers 131 also include fishbone laterals 151, but either or both could have laterals. Additionally, if the injectors are higher than the producers, the laterals can slant as needed towards the other well (not shown).

Figure 2:
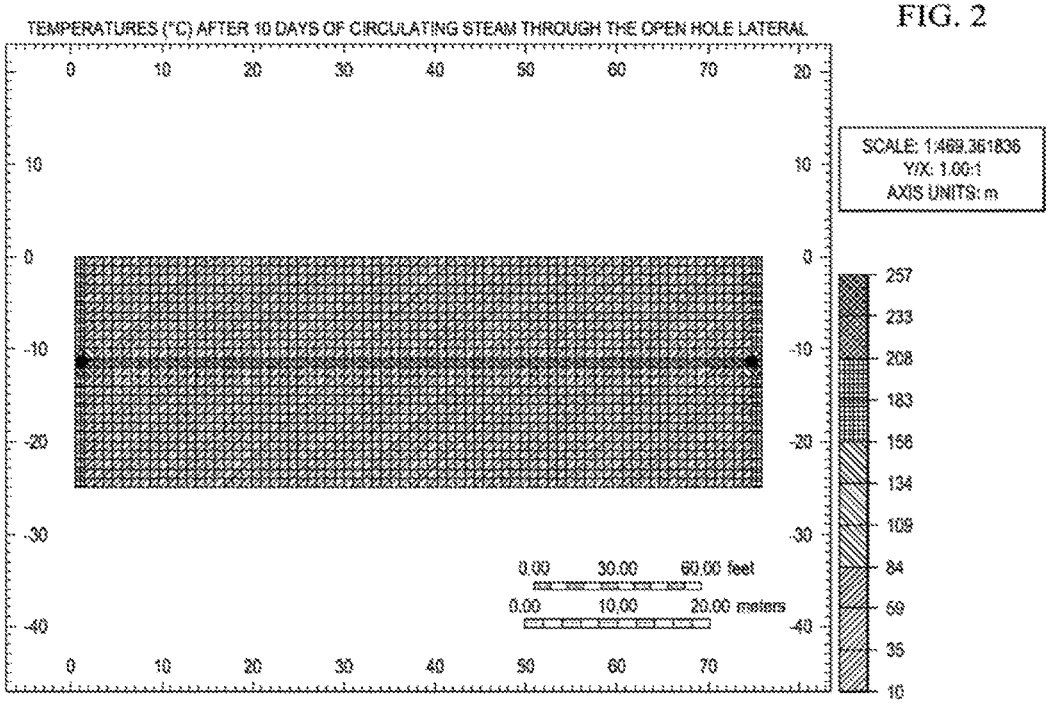
FIG. 2-3 shows a single lateral well from the side with a producer at the left end, and an injector on the right. Temperature modeling over time and under the conditions indicated on each graph is provided.
Figure 3:
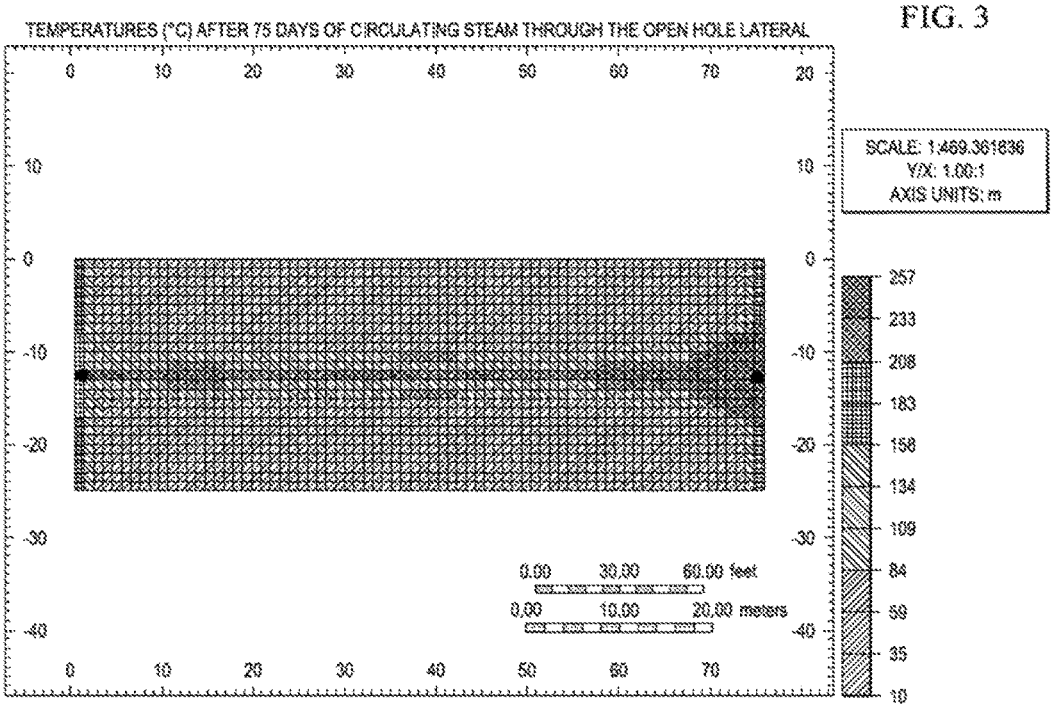

FIGS. 2-3 show the temperature modeling results for two wells, injector on the far right and producer on the far left, with a lateral connecting the two. In FIG. 2, after 10 days of simulated steam circulation, the only areas of heat are around the injection well, lateral and producer well. This initial steam circulation may be from circulation within the injector and/or producer (at least the one with the laterals) without fluid communication between the two. FIG. 3 shows steam injection at the injector with production at the producer (i.e., right to left).

Figure 4:
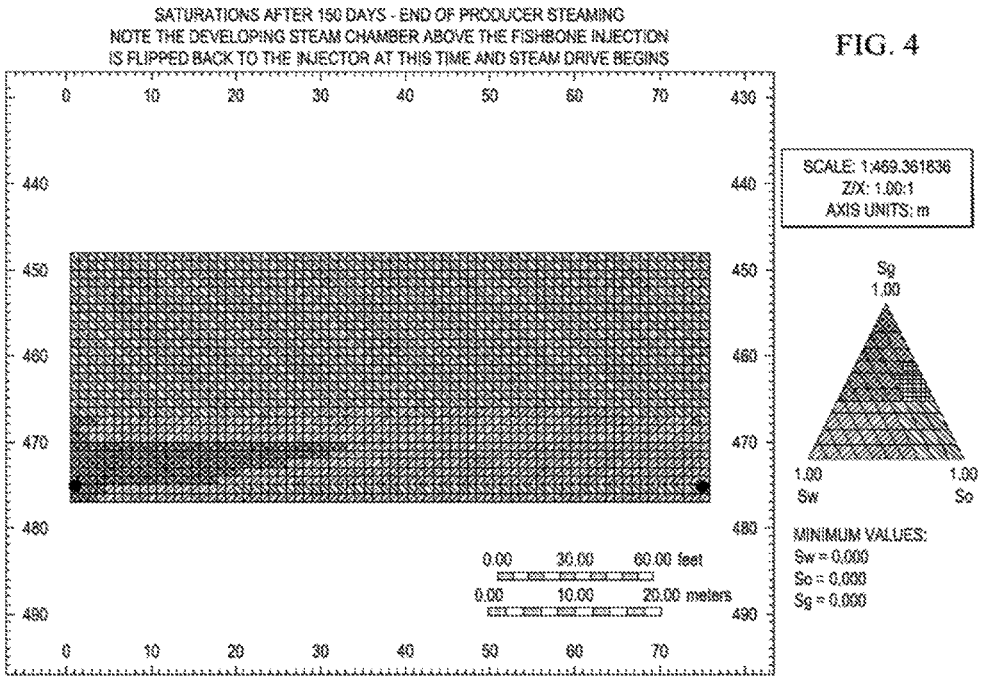
FIG. 4-7 show phase modeling over time and under the conditions indicated on each graph is provided. In these figures, the well orientation is the same as in FIG. 2, although the lateral (between dots) is positioned much lower in the figure. Sw=Water saturation [Three-Phase, Water-Oil system]; So=Oil saturation [Three-phase] and Sg=Gas saturation [Three-phase].

Once the volume around laterals is heated adequately, producer may be converted to injection and injector to production in order to better heat the volume around the producer (see FIG. 4 after flow of steam left to right).

Figure 5:
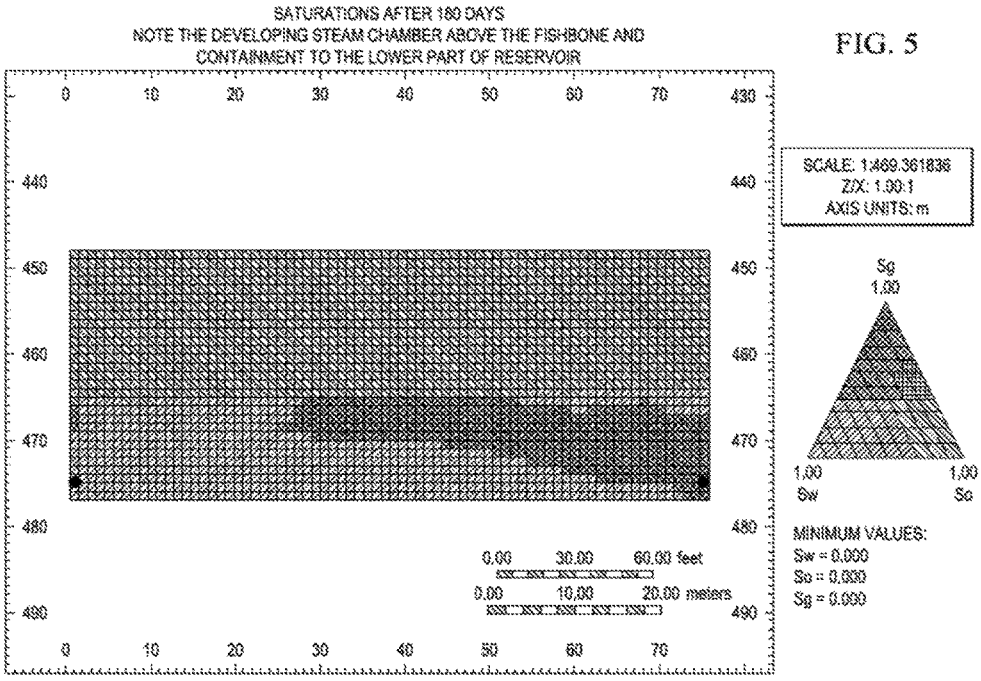

After the volume around the producer is well heated, steam is shut in and the injector is converted back to injection (i.e., right to left flow for injection-production) and the steam drive is started (FIG. 5). The larger steam chamber pushing left from the injector can be seen in this figure.

FIG. 4-7 show water, gas, oil saturation modeling results. The well setup is the same, with injector and producer to each side, and an open-hole lateral connecting them, but the lateral is near the bottom in each figure. With time, steam overrides the open-hole lateral rapidly heating up the volume between horizontal wells (FIG. 4-5).

Figure 6:
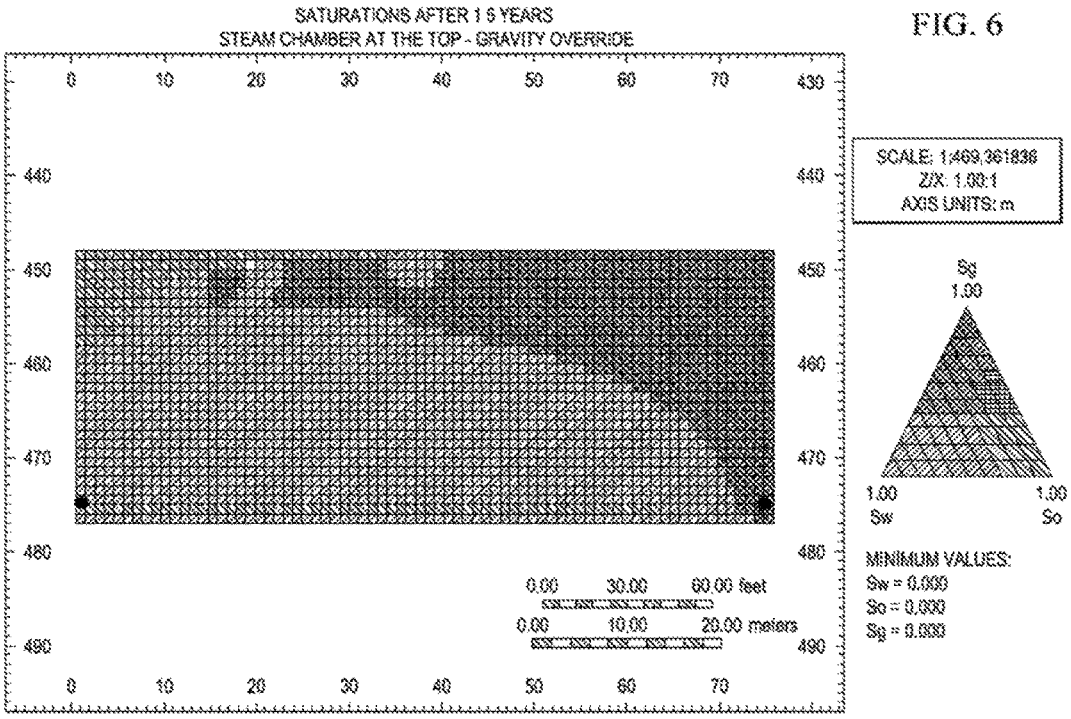
Figure 7:
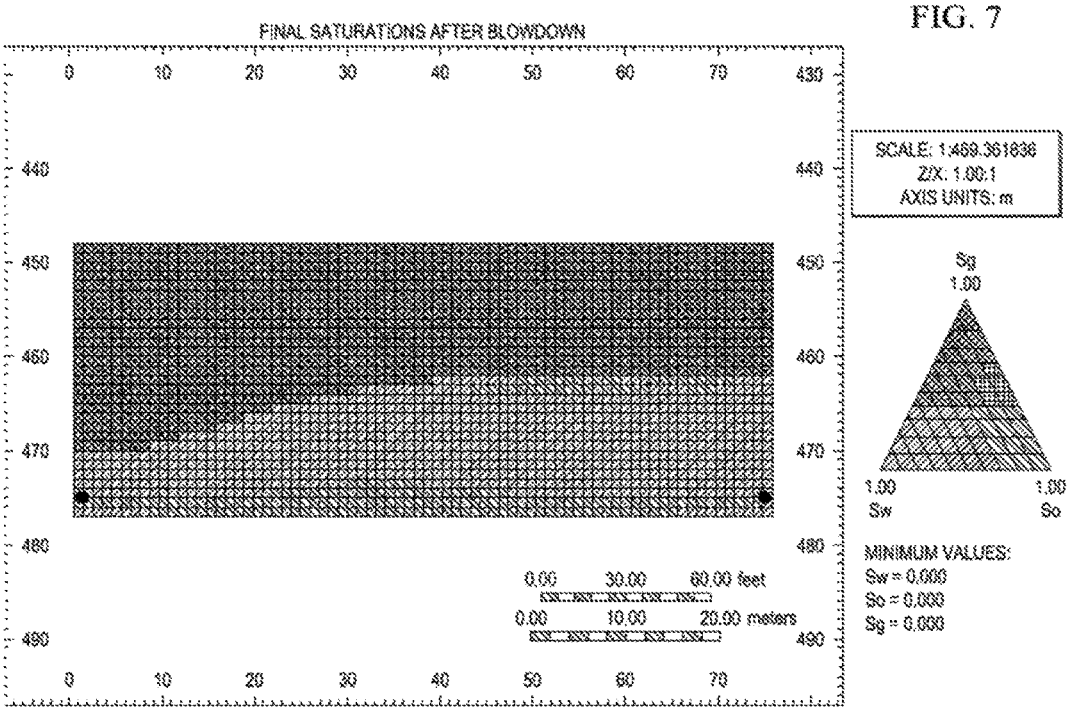

Most of early production is the result of pressure gradient between the 2 horizontal wells resulting in some accelerated production. In the final stage (blow down), steam injection is terminated and the stored energy in the reservoir is used to produce as much as possible of the remaining bitumen. FIG. 6 shows the override of the steam chamber due to rising of the steam. FIG. 7 shows the final saturation levels at end of the process.

Figure 8:
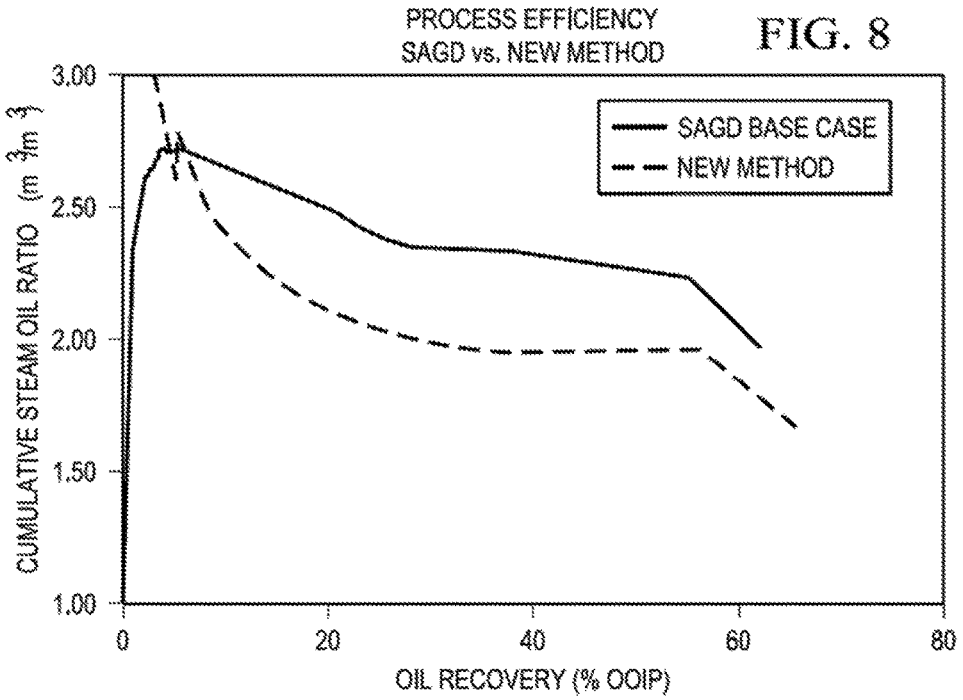
FIG. 8 compares the percentage original oil in place recovery versus cumulative steam to oil ratio for the same wells using traditional SAGD versus the new SD technique. For the same 60% OOIP recovery, less steam is used in the new method, providing a significant cost savings.

The disclosure takes advantage of open-hole laterals to rapidly heat up the volume between adjacent wells, mobilize the bitumen and enable the steam drive process. The method has the potential to considerably cut down on the number of wells needed to produce the reserves when compared to the SAGD process by eliminating one of the wells in the traditional SAGD well pair, and also allowing for wider development spacing. The process accelerates the recovery at a lower Steam Oil Ratio when compared to SAGD (FIG. 8).

Additional embodiments of the process include drilling a ghost hole 99 (open hole wellbore) above the producer 91, and connecting the producer 91 and injector 95 via a lateral 93. An additional lateral 97 is vertically slanted to or near the ghost hole (FIG. 9A). This would accelerate vertical steam chest development and the gravity override desired in the steam-drive sweep process. Two views are shown in FIG. 9, one facing the main lateral 93 (9A), and the other 90' to the first and facing the ghost hole 99 (9B).

Additional embodiments would include filling the fishbones/ghost hole with high permeability materials, such as proppants, gravel, metallic materials, radio frequency absorbing material (for EM heating), or coarse sand, which would help maintain a high permeability conduit advantageous during the initiation of the steam-drive process, and would solve the open hole collapse problem. This could also be achieved by running slotted liners or other completion systems that maintain hole integrity and the high permeability conduit required during the process initiation.

Figure 10B:
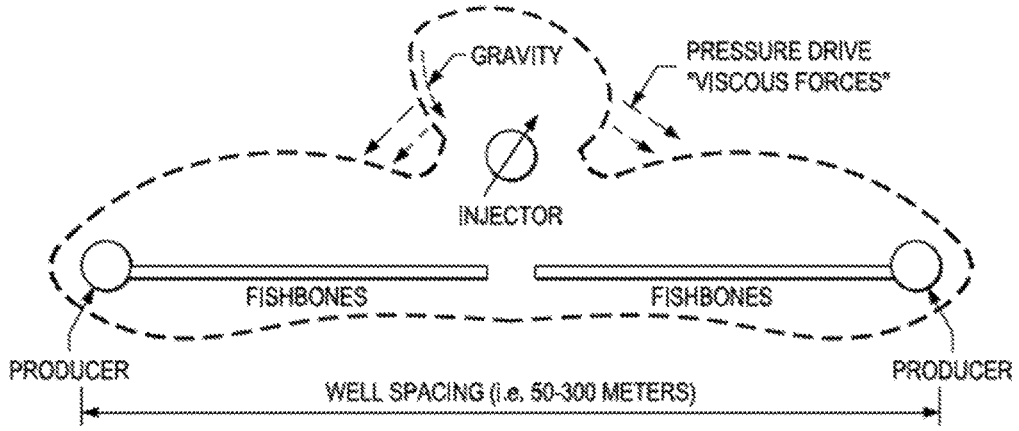
Figure 10C:
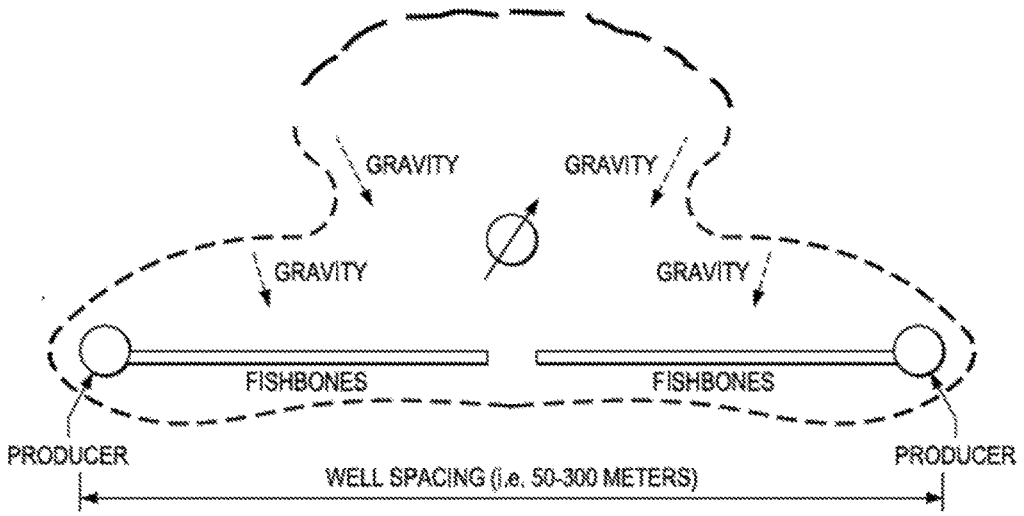

CSS-SD could be applicable in an offset injector producer arrangement shown in FIG. 10, which would allow for more efficient development of resources by reducing wellbores and surface facilities. In FIG. 10A an injector is only slightly higher and placed midway between a pair of producers, slightly lower in the pay. As steam is injected into the injector and travels along the laterals (fishbones) to the producers, the main driving force is steam drive. In FIG. 10B, a steam chamber is beginning to grow vertically, and some gravity is also contributing to the viscous drive. Eventually, in FIG. 10C the steam chamber will grow sufficiently that gravity becomes the dominant drive mechanism.

In an additional embodiment, this configuration of horizontal wells with fishbones could be applied to steam-solvent, steam-additive such as methane, propane or $CO_2$, or solvent only thermal or non-thermal processes. The process is also applicable to hydrocarbon reservoirs where CSS operations are the dominant recovery process. Additional embodiments of this process could include hybrid combinations of CSS, CSS-SD, SAGD-SD, where existing well infrastructure is utilized in the process.

The ribs can be placed in any arrangement known in the art, depending on reservoir characteristics and the positioning of nonporous rocks and the play.

The ribs can be planar or slanted or both, e.g., preferably slanting upwards towards the injectors, where injectors are placed higher in the pay. However, injectors need not be higher in the pay with this method. Nonetheless, upwardly slanted wells may be desirable to contact more of a thick pay, or where thin stacked pay zones exist. Downwardly slanting wells may also be used in some cases. Combinations of planar and slanted wells are also possible.

The rib arrangement on a particular main well can be pinnate, alternate, radial, or combinations thereof. The ribs can also have further ribs, if desired.

The following references are incorporated by reference in their entirety for all purposes:

STALDER J. L., et al., "Alternative Well Configurations in SAGD: Rearranging Wells to Improve Performance," presented at 2012 World Heavy Oil Congress [WHOC12], available online at www.osli.ca/uploads/files/Resources/Alternative%20Well%20Configurations%20in%20SAGD_WHOC2012.pdf Lougheide, et al., "Trinidad's First Multilateral Well Successfully Integrates Horizontal Openhole Gravel Packs," OTC 16244, (2004).

Stalder, et al., "Multilateral-Horizontal Wells Increase Rate and Lower Cost Per Barrel in the Zuata Field, Faja, Venezuela", SPE 69700-MS, Mar. 12, 2001.

Technical Advancements of Multilaterals (TAML) (2008). Available at taml-intl.org/taml-background/

Multilateral Completions Available at petrowiki.org/Multilateral_completions

Husain, et al., "Economic Comparison of Multi-Lateral Drilling over Horizontal Drilling for Marcellus Shale Field," EME 580 Final Report: (2011), available online at www.ems.psu.edu/~elsworth/courses/egee580/2011/Final%20Reports/fishbone_report.pdf Hogg, "Comparison of Multilateral Completion Scenarios and Their Application," presented at the Offshore Europe, Aberdeen, United Kingdom, 9-12 September. SPE-38493-MS (1997).

U.S. Pat. No. 8,333,245, 8,376,052 "Accelerated production of gas from a subterranean zone" (2004).

US20120247760 "Dual Injection Points In SAGD" (2012).

US20110067858 "Fishbone Well Configuration For In Situ Combustion" (2011).

US20120227966 "In Situ Catalytic Upgrading" (2012).

US-2014-0345861, "FISHBONE SAGD" (2014).

US-2014-0345855, "RADIAL FISHBONE SAGD" (2014).

CA2684049 "INFILL WELL METHODS FOR SAGD WELL HEAVY HYDROCARBON RECOVERY OPERATIONS" (2011).

What is claimed is:

1. A method of producing heavy oils from a reservoir by steam drive, comprising:

a) providing a plurality of horizontal production wells at a first depth at or near the bottom of a hydrocarbon play;

b) providing a plurality of horizontal injection wells, each injection well laterally spaced at a distance D from an adjacent production well;

c) providing a plurality of open hole ribs originating from said plurality of horizontal production wells or said plurality of horizontal injection wells or both, wherein said plurality of open hole ribs cover at least 95% of said distance D;

d) cycling between injecting steam and producing through the laterals before injecting steam into said injection wells and steam driving heated heavy oils towards said production wells for production;

e) providing an open hole horizontal ghost hole above at least one injection well, wherein one or more open hole ribs slants towards said open hole horizontal ghost hole, and commencing a steam assisted gravity drainage process once a steam chamber encompasses said open hole horizontal ghost hole;

f) wherein said reservoir contains bitumen or heavy oil immobile for steam drive without the use of said plurality of lateral wells.

2. The method of claim 1, wherein step d) includes alternating steam injection into said injection well and said production wells to improve steam injectivity before commencing steam drive step d).

3. The method of claim 1, wherein said distanced D is 50-300 meters.

4. The method of claim 1, wherein said distance D is at least 50 meters.

5. The method of claim 1, wherein said distance D is at least 100 meters.

6. The method of claim 1, wherein said distance D is at least 150 meters.

* * * * *